United States Patent [19]

Tahata

[11] Patent Number: 4,609,505

[45] Date of Patent: Sep. 2, 1986

[54] VARIABLE VENTURI TYPE CARBURETOR

[75] Inventor: Michio Tahata, Niiza, Japan

[73] Assignee: Honda Giken Kogyo Kabushiki Kaisha, Tokyo, Japan

[21] Appl. No.: 724,517

[22] Filed: Apr. 18, 1985

[30] Foreign Application Priority Data

Apr. 27, 1984 [JP] Japan ..... 59-85673

[51] Int. Cl.[4] ..... F02M 9/06

[52] U.S. Cl. ..... 261/41 R; 261/44 B; 261/52

[58] Field of Search ..... 261/44 B, 52, 41 R

[56] References Cited

U.S. PATENT DOCUMENTS

| | | | |
|---|---|---|---|
| 1,375,898 | 4/1921 | Ciglia et al. | 261/44 B |
| 2,047,661 | 7/1936 | Arff | 261/52 |
| 3,167,599 | 1/1965 | Brown et al. | 261/DIG. 68 |
| 3,169,154 | 2/1965 | Martin et al. | 261/DIG. 68 |
| 3,333,832 | 8/1967 | O'Neill | 261/52 |
| 3,738,622 | 6/1973 | Tuckey | 261/DIG. 68 |
| 4,442,046 | 4/1984 | Edmonston et al. | 261/44 B |

FOREIGN PATENT DOCUMENTS

| | | | |
|---|---|---|---|
| 55-1419 | 8/1980 | Japan | 261/44 B |

*Primary Examiner*—Tim Miles

*Attorney, Agent, or Firm*—Roberts, Spiecens & Cohen

[57] ABSTRACT

A variable venturi type carburetor comprising a carburetor body provided with a suction passage for flow of air therethrough, a slide valve supported by the body for slidable movement across the suction passage to serve as a variable venturi and a butterfly throttle valve pivotably supported by the carburetor body downstream of the slide valve. An interlocking mechanism connects the slide valve and butterfly throttle valve together for operating in correspondence with one another and one of the valves is operated by application of an external force thereto. A low-speed fuel nozzle opens into the suction passage in the vicinity of the butterfly throttle valve, an intermediate- and high-speed main fuel nozzle opens into the suction passage opposite the slide valve, and a low- and intermediate-speed primary fuel nozzle opens into the suction passage between the slide valve and the butterfly throttle valve. The lower edge of the slide valve is formed with an inverted cutaway to provide a widened passage facing in the downstream direction of the suction passage.

8 Claims, 3 Drawing Figures

VARIABLE VENTURI TYPE CARBURETOR

FIELD OF THE INVENTION

This invention relates to a carburetor of variable venturi type and associated method of operation.

DESCRIPTION OF PRIOR ART

In conventional carburetors of variable venturi type a slide throttle valve capable of being moved slidingly across a suction passage is operated by a throttle wire. In such carburetor, the throttle slide valve is subjected to a force acting downstream, in the suction direction of air flow, due to the vacuum produced in the engine. Consequently, a relatively large frictional force is developed between the side surface of the slide throttle valve which faces in the downstream direction and the opposed surface of the carburetor body. Therefore, a relatively large tractive force is necessary to operate the throttle wire.

A variable venturi carburetor of so-called constant-vacuum type has also been developed in an effort to eliminate these deficiencies. In this carburetor the vacuum is controlled by means of a butterfly throttle valve provided in the suction passage and the slide throttle valve is opened and closed in accordance with the resulting vacuum. However, if the open degree of the butterfly throttle valve in this carburetor is increased suddenly, the vacuum does not increase accordingly. In consequence, the action of the slide throttle valve does not follow the sudden acceleration operation. Thus, this variable venturi type carburetor has a low acceleration response The present inventor has already proposed a variable venturi type carburetor which is intended to eliminate these deficiencies. In this carburetor, the butterfly throttle valve and the slide valve are operatively connected for operation in correspondence with one another, and a low-speed fuel discharge port and a main fuel nozzle are respectively provided in the vicinity of the butterfly throttle valve and just under the slide valve. According to this arrangement, the acceleration response of the slide valve can be improved. In addition, the discharge rate of fuel from the low-speed fuel discharge port can be controlled properly in the low-load operational region, and the discharge rate of fuel from the main fuel nozzle can be controlled properly in the high-load operational region.

In the carburetor of the above-described construction, the slide valve and the butterfly throttle valve are moved by operating a throttle wire by application of external force thereto. Accordingly, the vacuum in the suction passage does not increase in accordance with sudden opening operations of these two valves under certain operational conditions. In such case, the discharge rate of fuel from the main fuel nozzle becomes insufficiently low in the region of an intermediate degree of opening of the slide valve.

SUMMARY OF THE INVENTION

An object of the present invention is to provide a construction which avoids the deficiencies of the known carburetor.

It is a particular object of the present invention to provide a variable venturi type carburetor capable of producing an excellent air-fuel ratio in all operational regions, i.e. from the low-load operational region to the high-load operational region.

In order to satisfy the above and further objects of the invention, a carburetor is provided, which comprises a carburetor body having a suction passage therein, a slide valve supported by said body for slidable movement across said suction passage to function as a variable venturi, a butterfly throttle valve pivotably supported by the carburetor body downstream of the slide valve, interlocking means connecting the slide valve and the butterfly throttle valve together for operation in correspondence with one another, operating means connected to one of said valves for operating the same by application of external force thereto, a low-speed fuel nozzle opening into the suction passage in the vicinity of the butterfly throttle valve, an intermediate and high-speed main fuel nozzle opening into the suction passage just under the slide valve, and a low and intermediate-speed primary fuel nozzle opening into the suction passage between the slide valve and the butterfly throttle valve.

According to this arrangement, the discharge rates of fuel from the low-speed fuel nozzle, the main fuel nozzle and the primary fuel nozzle can be controlled properly in a low-load operational region, intermediate-and high-load operational regions and a transitional region, in which low-load operation of the engine is shifted to intermediate and high-load operations respectively. Therefore, an excellent air-fuel ratio can be obtained in all operational regions.

DETAILED DESCRIPTION OF PREFERRED EMBODIMENTS

Figure 1:
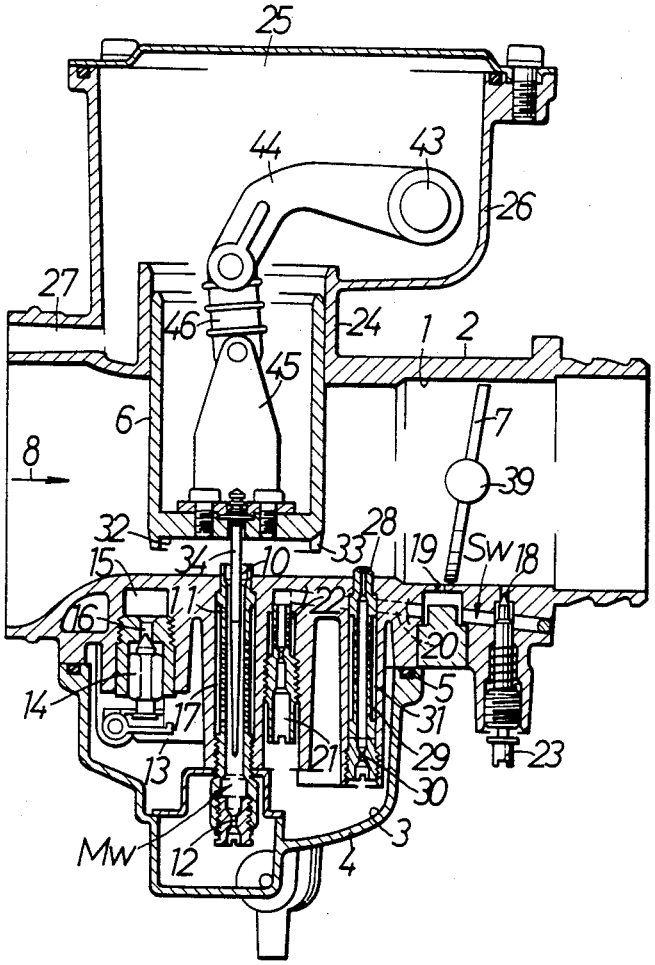
FIG. 1 is a longitudinal sectional view of one embodiment of the carburetor of the invention.

An embodiment of the present invention will now be described with reference to the drawing wherein a float chamber body 4 forming a float chamber 3 is secured via a seal member 5 to a lower portion of a carburetor body 2 in which a suction passage 1 is formed. In suction passage 1 is a slide valve 6 adapted to be moved slidingly across the suction passage 1, and a butterfly throttle valve 7 pivotably supported by the carburetor body 2 on the downstream side of the slide valve 6 with respect to the direction of air flow 8, i.e., the suction direction. The slide valve 6 and the butterfly throttle valve 7 are operated correlatively from their fully-closed positions to their fully-opened positions.

The carburetor body 2 is provided with an intermediate and high speed main fuel nozzle 10 which opens at the inner surface of the suction passage 1. An air bleeder pipe 11 is connected to a lower portion of the main fuel nozzle 10 integrally and concentrically. A main fuel jet 12 extending under the fuel level in the float chamber 3 is joined to a lower portion of the air bleeder pipe 11. Thus, a main fuel passage Mw extending from the main fuel jet 12 to the main fuel nozzle 10 via the air bleeder pipe 11 is formed. The main fuel passage Mw opens into the suction passage 1 just under the slide valve 6. An annular chamber 17 formed around the air bleeder pipe 11 is in communication with an upstream end of the suction passage 1 via an air bleeder passage (not shown).

The carburetor body 2 is further provided with a low speed fuel passage Sw which opens into the suction passage 1 in the vicinity of the butterfly throttle valve 7. A pilot outlet 18, which opens into the suction passage 1 on the slightly downstream side of the butterfly throttle valve 7, and a low speed fuel nozzle 19, which opens into the suction passage 1 on the slightly upstream side of the butterfly throttle valve 7 in its fully-closed position are also provided in the carburetor body 2. The pilot outlet 18 and the fuel nozzle 19 are in communication with a fuel passage 20. A low speed fuel jet 21, which extends under the fuel level in the float chamber 3, is connected to the fuel passage 20 via an air bleeder pipe 22. In order to regulate the degree of opening of the pilot outlet 18, a pilot screw 23 is engaged with the carburetor body 2 so that the pilot screw 23 can be turned to advance upwardly and downwardly.

The carburetor body 2 is further provided, at its lower portion, with a low and intermediate speed primary fuel nozzle 28 which opens into the suction passage 1 between the slide valve 6 and the butterfly throttle valve 7. An air bleeder pipe 29 is connected to a lower portion of the primary fuel nozzle 28 integrally and concentrically. A primary fuel jet 30 which extends under the fuel level in the float chamber 3 is joined to a lower portion of the air bleeder pipe 29. An annular chamber 31 formed around the air bleeder pipe 29 is in communication with an upstream end of the suction passage 1 via an air bleeder passage (not shown).

A float 13 is housed in the float chamber 3. A float valve 14 is engaged with a pivotably supported portion of the float 13 so as to open and close a valve port 16 in accordance with vertical movement of the float 13. The valve port 16 is in communication with a fuel supply passage 15 formed in the carburetor 2.

A guide cylinder 24 extends upwardly at an upper portion of the carburetor body 2 at a location opposite the main fuel nozzle 10. The guide cylinder is integral with the carburetor body 2. A housing 26 forming an air chamber 25 is integrally joined to an upper portion of the guide cylinder 24. The air chamber 25 is in communication with an upstream end of the suction passage 1 via a passage 27.

The slide valve 6 is formed in the shape of an open top, closed bottom cylinder, and the valve 6 is fitted slidably in the guide cylinder 24. A needle valve 34 is secured to the bottom of the slide valve 6 and is inserted into the main fuel nozzle 10. An upwardly extending recess 32 is provided in the lower end surface of the slide valve 6 and an inverted cutaway 33 is formed in the side surface at the bottom of slide valve 6 on the downstream side with respect to the suction direction 8. The recess 32 thus provided causes turbulence to occur in the air flow therein, so that the vacuum applied to the main fuel nozzle 10 can be made uniform. The cutaway 33 enables the vacuum in the space between the bottom portion of the slide valve 6 and the inner surface of the wall of the suction passage 1, i.e., a venturi portion, to increase. Consequently, the discharge rate of fuel from the main fuel nozzle 10 increases, and the regulation of the air-fuel ratio can be easily effected.

A shaft 43 which extends parallel to a valve shaft 39 of the butterfly throttle valve 7 is pivotably supported in the housing 26, and a driving arm 44 is connected fixedly at one end thereof to the pivotable shaft 43 in the air chamber 25. A bracket 45 is connected fixedly to the slide valve 6. The bracket 45 is also connected at the other end thereof to the other end of the driving arm 44 by a connecting rod 46. Accordingly, reciprocating pivotal movements of the pivotable shaft 43 are converted into linear reciprocating movements of the slide valve 6 along the guide cylinder 24, i.e., the opening and closing movements of the slide valve 6, via the driving arm 44, connecting rod 46 and bracket 45.

Figure 2:
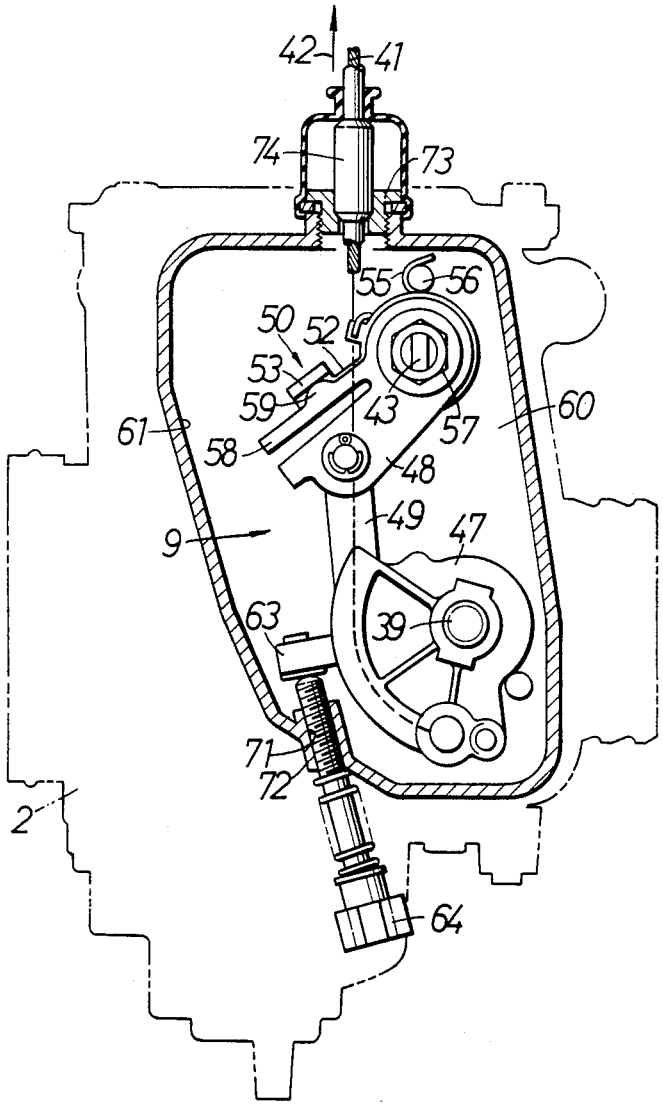
FIG. 2 is a sectional front elevational view showing the construction of an interlocking mechanism of the carburetor.
Figure 3:
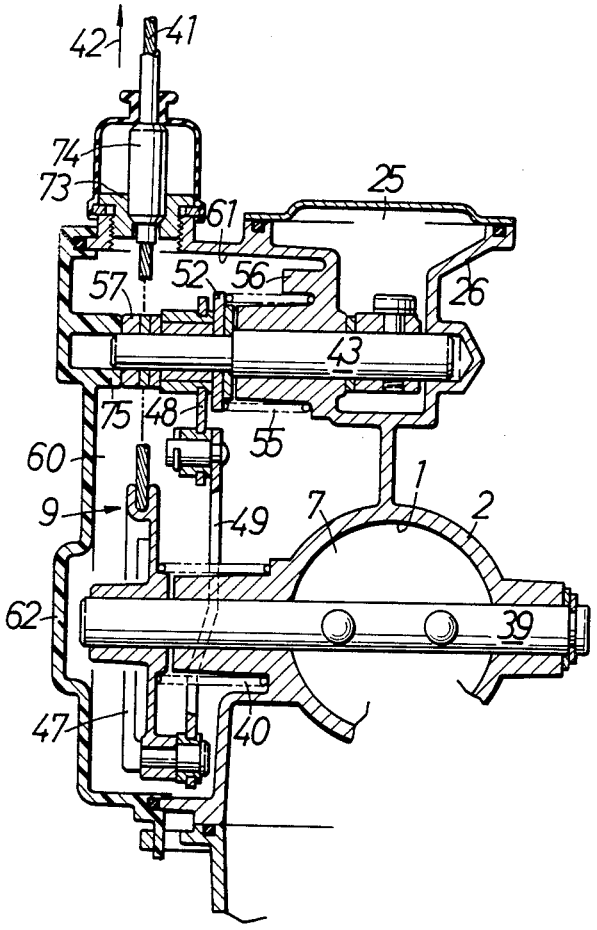
FIG. 3 is a side elevational view, in section, of a principal portion of the interior of a housing chamber of the carburetor.

Referring to FIGS. 2–3, the valve shaft 39 of the butterfly throttle valve 7 and the pivotable shaft 43 are connected together via an interlocking mechanism 9 so as to correlate the opening and closing actions of the slide valve 6 with those of the butterfly valve 7. The interlocking mechanism 9 is arranged in a housing chamber 60 provided at a side portion of the carburetor body 2. The housing chamber 60 is defined by a wall of a housing recess 61 provided at a side portion of the carburetor body 2, and a cover member 62 fastened to the carburetor body 2 so as to close the housing recess 61.

The interlocking mechanism 9 consists of a throttle lever 47 press-fitted firmly around an end portion of the valve shaft 39, a pivotable arm 48 mounted on an end portion of the pivotable shaft 43, and a connecting arm 49 fixed at one end to the pivotable arm 48 and joined at the other end thereof to the portion of the throttle lever 47 which is remote from the axis thereof. A regulator mechanism 50 is interposed between the pivotable arm 48 and the pivotable shaft 43. A throttle wire 41 is connected to the throttle lever 47. When the throttle wire 41 is drawn in the direction of arrow 42, the butterfly throttle valve 7 is turned in the opening direction. The butterfly throttle valve 7 is urged in the closing direction by a coil spring 40 so that when the tractive force of the throttle wire 41 is decreased, the butterfly throttle valve 7 is turned in the closing direction. The opening and closing actions of the butterfly throttle valve 7 are transmitted to the pivotable shaft 43 via the interlocking mechanism 9 and the regulator mechanism 50 so that the slide valve 6 is opened or closed in accordance with the pivotal movement of the shaft 43.

The regulator mechanism 50 consists of a lever 52 which is mounted on an end portion of the pivotable shaft 43 so that the lever 52 is angularly fixed on the shaft 43 and extends in the same direction as the pivotable arm 48, a projection 53 provided on the lever 52, and a coil spring 55 urging the lever 52 to turn in the direction in which the projection 53 comes into contact with the pivotable arm 48. The coil spring 55 is fitted around the pivotable shaft 43 and is engaged at one end with an integral pin 56 in the housing 26, and at the other end with the lever 52. The pivotable arm 48 is fitted at its base portion around the pivotable shaft 43 so that the arm 48 can be turned relative to the shaft 43. A setting nut 57 is fixedly secured at an end of the pivotable shaft 43 so as to prevent the pivotable arm 48 from coming off from the shaft 43. The pivotable arm 48 is provided with a contact arm 58 which is capable of regulating the circumferential distance between the arm 58 and the portion of the pivotable arm 48 to which the connecting arm 49 is joined. The contact arm 58 is provided with a projection 59 engageable with the projection 53.

In the interlocking mechanism 9 and the regulator mechanism 50, which are formed as described above, the operation of the throttle lever 47 for opening the butterfly throttle valve 7, i.e., clockwise pivotal movement in FIG. 2 of the lever 47, is transmitted to the pivotable arm 48 to cause the arm 48 to turn clockwise. Since the projection 53 in the regulator mechanism 50 is engaged resiliently with the projection 59 of the pivotable arm 48, the lever 52 and the shaft 43 are turned clockwise. The pivotal movement of the shaft 43 is transmitted to the slide valve 6 via the driving arm 44, connecting rod 46 and bracket 45, so that the slide valve 6 is displaced upwardly along the guide cylinder 24, i.e., moved in the opening direction.

Conversely, when the butterfly throttle valve 7 is turned counterclockwise in FIG. 2, the pivotable arm 48 is also turned counterclockwise. In accordance with the counterclockwise movement of the pivotable arm 48, the lever 52, i.e., the pivotable shaft 43 turns counterclockwise by the resilient force of the coil spring 55 as the projection 53 follows the projection 59 in a contacting state. Consequently, the slide valve 6 is forced downwardly via the driving arm 44, connecting rod 46 and bracket 45, i.e., moved in the closing direction. At this time, the pivotable arm 48 can be turned counterclockwise by the regulator mechanism 50. Therefore, the butterfly throttle valve 7 can be closed irrespective of the movement of the slide valve 6.

The regulator mechanism 50 is capable of finely regulating the degree of opening of the slide valve 6 with respect to that of the butterfly throttle valve 7 by regulating the distance between the portion of the pivotable arm 48 to which the connecting arm 49 is joined and the contact arm 58. Since the projection 53 resiliently engages the projection 59, any vibration of the throttle lever 47, pivotable arm 48 and connecting arm 49, due to mounting errors is damped so that the interlocking mechanism is operated smoothly.

The throttle lever 47 is provided with a limit projection 63 extending laterally therefrom. A stop screw 64 is engaged in a threaded bore 71 in a boss 72 formed integrally with the cover member 62, so as to contact the limit projection 63. A loosening-preventing portion 75, opposed to an end surface of the pivotable shaft 43, projects from the cover member 62. The loosening-preventing portion 75 is adapted to engage setting nut 57 and prevent the same from being loosened. A cap 73 is engaged with an upper portion of the wall of the housing recess 61, and an end portion of an outer wire 74 is fixedly secured in the cap 73. The throttle wire 41 which can be moved through the outer wire 74 is connected to the throttle lever 47 within the housing chamber 60.

The operation of this embodiment will now be described.

In accordance with the opening and closing actions of butterfly valve 7 by drawing the throttle valve wire 41, the slide valve 6 is opened and closed via the interlocking mechanism 9. During this time, the suction vacuum does not directly cause the slide valve 6 to be drawn in a downstream direction since the butterfly throttle valve 7 is provided on the downstream side of the slide valve 6. Accordingly, the frictional resistance between the outer surface of the slide valve 6 and the inner surface of the guide cyliner 24 is comparatively low, so that the throttle wire 41 can be operated by a comparatively small tractive force. Moreover, when the opening degree of the butterfly throttle valve 7 is increased suddenly for sudden acceleration of the engine, the slide valve 6 is opened without delay and excellent acceleration can be obtained.

In the case where the opening degree of the butterfly throttle valve 7 is set to a low level to carry out low-load operation of the engine, the discharge rate of fuel from the low-speed fuel nozzle 19 can be controlled in accordance with the opening degree of the valve 7 since the nozzle 19 is provided in the vicinity of the valve 7 and the discharge rate can be controlled with high accuracy.

When the opening degree of the slide valve 6 is set to an intermediate or high level so as to operate the engine with an intermediate or high load, the slide valve 6 carries out its venturi effect to control the vacuum above the main fuel nozzle 10 in accordance with the load. The discharge rate of fuel from the main fuel nozzle 10 is thus regulated to enable the production of a fuel mixture suitable for intermediate and high-load operations of the engine.

When the slide valve 6 is opened suddenly to shift a low-load operation of the engine to an intermediate-load operation thereof, the vacuum in the suction passage 1 does not increase accordingly in some cases. In such cases, there is the possibility that the discharge rate of fuel from the main fuel nozzle 10 becomes insufficiently low. If this occurs, the vacuum in the portion of the suction passage 1 which is between the butterfly throttle valve 7 and the slide valve 6 becomes greater than that below the slide valve 6. Since the low and intermediate-speed primary fuel nozzle 28 opens into the suction passage 1 between the butterfly throttle valve 7 and the slide valve 6, the fuel is discharged from the nozzle 28 so as to compensate for the shortage of fuel discharged from the main fuel nozzle 10.

Thus, an excellent air-fuel ratio can be obtained in all operational regions of the engine, i.e. from the low-load operational region to the high-load operational region.

According to the present invention as described above, a novel carburetor is provided, which comprises carburetor body 1 provided with suction passage 2, slide valve 6 slidingly movable across the suction passage and functioning as a variable venturi, butterfly throttle valve 7 pivotably supported on the carburetor body downstream of the slide valve, interlocking mechanism 9 connecting the slide valve and the butterfly throttle valve for corresponding movement together, operating member 41 connected to one of the valves (valve 7 in the embodiment) to operate the valve by application of external force thereto, low-speed fuel nozzle 19 which opens into the suction passage in the vicinity of the butterfly throttle valve, intermediate and high-speed main fuel nozzle 10 which opens into the suction passage just under the slide valve 6, and low- and intermediate-speed primary fuel nozzle 28 which opens into the suction passage between the slide valve and the butterfly throttle valve.

Therefore, in a low-load operational region, the flow rate of fuel and the air-fuel ratio are controlled properly by the butterfly throttle valve, and, in the intermediate and high operational regions, the discharge rate of fuel from the main fuel nozzle is controlled by the slide valve. When the operating member suddenly opens the valve to which it is connected to go from a low-load operation of the engine to an intermediate or high-load operation thereof, fuel is discharged from the primary fuel nozzle 28 to compensate for the shortage of fuel discharged from the main fuel nozzle 10. Accordingly, the discharge rate of fuel does not become insufficiently low and an excellent air-fuel ratio can be obtained in all operational regions of the engine, i.e. from the low-load operational region to the high-load operational region thereof.

Although the invention has been described in relation to specific preferred embodiments thereof, it will become apparent to those skilled in the art that numerous modifications and variations can be made without departing from the scope and spirit of the invention as defined in the attached claims.

What is claimed is:

1. A variable venturi type carburetor comprising a carburetor body provided with a suction passage therein for flow of air through said passage, a slide valve supported by said body for slidable movement across said suction passage to serve as a variable venturi, a butterfly throttle valve pivotably supported by said carburetor body downstream of said slide valve, interlocking means connecting said slide valve and said butterfly throttle valve together for operating in correspondence with one another, operating means connected to one of said valves for operating the same by application of an external force thereto, a low-speed fuel nozzle opening into said suction passage in the vicinity of said butterfly throttle valve, an intermediate- and high speed main fuel nozzle opening into said suction passage opposite said slide valve, and a low and intermediate-speed primary fuel nozzle opening into said suction passage between said slide valve and said butterfly throttle valve, said slide valve including a bottom portion having a front side surface facing upstream in the suction passsage and a rear side surface facing downstream in the suction passage, said front and rear side surfaces having lower edges which are located in the same horizontal plane, said rear side surface being provided with an inverted cutaway.

2. Available venturi type carburetor as claimed in claim 1 wherein said inverted cutaway widens in the downstream direction in said suction passage.

3. A variable venturi type carburetor as claimed in claim 1, wherein said bottom portion is provided with a recess therein.

4. A variable venturi type carburetor as claimed in claim 1 wherein said low- and intermediate speed primary fuel nozzle is located downstream of said slide valve.

5. A variable venturi type carburetor as claimed in claim 1 comprising a float chamber connected to said carburetor body, said low-speed fuel nozzle, intermediate and high-speed fuel nozzle and low- and intermediate-speed primary fuel nozzle being in communication with said float chamber.

6. A method of operating a venturi type carburetor having a carburetor body provided with a suction passage, a slide valve slidably movable across said suction passage to serve as a variable venturi, a pivotable butterfly throttle valve downstream of the slide valve, interlocking means connecting said valves together for corresponding movement, and operating means for applying external force to one of said valves to operate the same, said method comprising discharging fuel into said suction passage in the vicinity of said butterfly throttle valve, from a low-speed fuel nozzle, during low speed engine operation, discharging fuel into said suction passage opposite said slide valve, from a main fuel nozzle, during intermediate and high-speed engine operation, the bottom of the slide valve facing the opposite wall of the carburetor body and the main fuel nozzle being formed with a planar lower edge and being provided with an inverted cutaway facing in the downstream direction of the suction passage for increasing the venturi portion and thereby increasing fuel discharge from said main nozzle, and discharging fuel into said suction passage in a region between said slide valve and said throttle valve, from a primary fuel nozzle, during low and intermediate speed engine operation to compensate for shortage of fuel discharged from said main fuel nozzle opposite said slide valve when said slide valve is opened suddenly in going from low load engine operation to intermediate load engine operation, whereby to provide desirable air-fuel ratio of fuel mixture from low-load to high-load engine operation.

7. A method as claimed in claim 6 comprising forming a turbulent flow region for air in said suction passage below said slide valve so that vacuum applied to said main fuel nozzle is rendered uniform.

8. A method as claimed in claim 6 wherein for increasing said venturi portion, the inverted cutaway is formed to widen in the downstream direction of said suction passage.

* * * * *